US007350898B2

(12) United States Patent
Lee

(10) Patent No.: US 7,350,898 B2
(45) Date of Patent: Apr. 1, 2008

(54) NOZZLE TAPE USED WITH INKJET CARTRIDGE

(75) Inventor: Jae-Cheol Lee, Hwaseong-gun (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 302 days.

(21) Appl. No.: 11/016,758

(22) Filed: Dec. 21, 2004

(65) Prior Publication Data

US 2006/0007282 A1 Jan. 12, 2006

(30) Foreign Application Priority Data

Jul. 12, 2004 (KR) ..... 10-2004-0054156

(51) Int. Cl.
*B21J 2/165* (2006.01)

(52) U.S. Cl. ..... 347/29; 347/47; 347/85

(58) Field of Classification Search ..... 347/20, 347/22, 29, 44, 47, 49, 84–87, 50
See application file for complete search history.

(56) References Cited

U.S. PATENT DOCUMENTS 5,414,454 A * 5/1995 Reid ..... 347/29
2005/0174386 A1* 8/2005 Spivey et al. ..... 347/47

FOREIGN PATENT DOCUMENTS

JP 57-182452 11/1982
JP 06-320741 11/1994
KR 10-224953 7/1999

* cited by examiner

*Primary Examiner*—Juanita D. Stephens
(74) *Attorney, Agent, or Firm*—Stanzione & Kim, LLP

(57) ABSTRACT

A nozzle tape for an inkjet cartridge is attached to the inkjet cartridge including a head chip, a cartridge body provided with a head chip-mounting portion spaced apart from edges of the head chip by a predetermined extent, and at least one bead member protruded along the edges of the head chip, wherein the nozzle tape is provided with at least one communication portion in fluid communication with a spaced gap between the head chip and the head chip-mounting portion to make the air trapped under the nozzle tape communicate with external air through the communication portion, thereby tightly attaching the nozzle tape to the nozzles, regardless of changes of an external environment.

40 Claims, 8 Drawing Sheets

NOZZLE TAPE USED WITH INKJET CARTRIDGE

CROSS-REFERENCE TO RELATED APPLICATIONS

This application claims the benefit of Korean Patent Application No. 2004-51456 filed on Jul. 12, 2004, the disclosure of which is hereby incorporated herein by reference in its entirety.

BACKGROUND OF THE INVENTION

1. Field of the Invention

The present general inventive concept relates to an apparatus to seal a head chip nozzle of an inkjet cartridge in an image forming, and more particularly, to a nozzle tape to seal a nozzle surface of a head chip in order to prevent ink from leaking out of an inkjet cartridge during transportation and storage of the inkjet cartridge after the inkjet cartridge is assembled.

2. Description of the Related Art

FIG. 1 is a perspective view illustrating a state before a nozzle tape 16 is attached to a conventional inkjet cartridge 10, FIG. 2 is a cross-sectional view taken along a line I-I of FIG. 1, and FIG. 3 is a cross-sectional view taken along a line II-II of FIG. 1.

Referring to FIGS. 1, 2 and 3, a head chip 13 of the inkjet cartridge 10 is mounted on a head chip-mounting portion 12 formed at one side of a cartridge body 18.

A bottom sealant (not shown) for bonding the head chip 13 is applied on a bottom surface of the head chip-mounting portion 12, and a print head assembly provided with the head chip 13 and a flexible print circuit 21 connected to the head chip 13 is installed on the bottom sealant. In addition, a side sealant 19 is applied to seal a spaced gap between the head chip 13 and the head chip-mounting portion 12 in order to prevent ink from penetrating under the flexible print circuit 21 and conductors 22 to generate an electrical short between the conductors 22.

The flexible print circuit 21 is provided with the conductor 22 connected to the head chip 13 at its one end and connected to a contact pad 22*a* at the other end to transmit a control signal for ejecting the ink to the head chip 13. In this connection, a bead member 11 is applied to protect a connecting part of the head chip 13 and the conductor 22.

The ink is filled in the inkjet cartridge 10 to form a meniscus of the ink in nozzles 15. The inkjet cartridge 10 shown in FIGS. 2 and 3 is a color inkjet cartridge, of which the nozzles 15 are briefly illustrated to have the number less than the actual number, viewing from a longitudinal cross-sectional view of FIG. 2, and of which three nozzles 15 are formed to eject the ink of cyan, magenta and yellow, respectively, viewing from a lateral cross-sectional view of FIG. 3.

The nozzle tape 16 is attached to cover the flexible print circuit 21, the bead member 11, the head chip 13 and the head chip-mounting portion 12 to prevent the ink from leaking from the nozzles 15.

When the inkjet cartridge 10 is sealed by the nozzle tape 16, as shown in FIG. 3, air 14 is trapped under the nozzle tape 16 since the side sealant 19 is filled in the spaced gap formed between the head chip 13 and the head chip-mounting portion 12 but is not fully filled in the gap. The trapped air 14 is expanded by a temperature increase or a pressure drop caused by changes of external environments, and the nozzle 15 is opened as the nozzle tape is separated from a surface of the head chip 13 located on the nozzle 15 by an expansion force, thereby causing the ink leakage.

FIG. 4 is a cross-sectional view illustrating a state that the nozzle tape 16 is separated from a surface of a head chip by air expansion. Referring to FIGS. 1-4, a leaking ink 30 is penetrated between the nozzle tape 16 and the nozzle 15 to separate from each other due to a capillary phenomenon. As a result, the nozzle tape 16 loses its nozzle sealing function.

The leaked ink 30 not only causes various colors of the ink to be mixed but also breaks the meniscus of the ink due to a back flow through the nozzle 15, and the air is introduced into the head chip 13 through the nozzle 15, thereby causing a serious defect such as a loss of an ink supply function.

Meanwhile, Japanese Laid-Open Publication No. H06-320741, entitled "Method of Sealing Nozzle and Nozzle Tape used therein," discloses a nozzle tape for preventing ink from leaking. The nozzle tape, e.g., an adhesive polymer tape having a slit, is attached to a printer head of a printer cartridge. Although the slit in parallel with a bead member is formed in order to solve a separation problem of the polymer tape due to a gap between the polymer tape and the nozzle surface and an ink penetration through the gap, generated by the bead member protruding from the nozzle surface, a nozzle tape separation phenomenon generated by an air trap in two spaced gaps, at which the bead member is not formed, could not be solved.

SUMMARY OF THE INVENTION

The present general inventive concept provides a nozzle tape used with an inkjet cartridge which is capable of preventing the nozzle tape from being separated from a nozzle surface as air trapped under the nozzle tape is expanded by changes of an ambient environment such as a temperature increase and a pressure change during transportation and storage of assembled inkjet cartridges.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing a nozzle tape used with an inkjet cartridge including a head chip, a cartridge body provided with a head chip-mounting portion spaced apart from edges of the head chip by a predetermined extent, and at least one bead member protruded along the edges of the head chip, wherein the nozzle tape has at least one communication portion in fluid communication with a spaced gap between the head chip and the head chip-mounting portion.

The nozzle tape may seal nozzles by forming the communication portion through which air may pass in the nozzle tape in order to prevent ink from leaking due to separation of the nozzle tape sealing the nozzles of the head chip as the air trapped in the spaced gap between the head chip and the head chip-mounting portion is expanded.

The communication portion may be variously formed of, for example, a slit formed in parallel with the spaced gap, a plurality of slits disposed in parallel with the spaced gap in a row, or a rectangular hole formed in parallel with the spaced gap.

The communication portion may also be formed of a hole in fluid communication with the spaced gap or formed of a plurality of holes formed in parallel with the spaced gap.

The at least one bead member may comprise two bead members in parallel with two edges of the head chip, the two communication portions may be symmetrically disposed in alignment with the spaced gap, and the communication portion may be provided with a slit vertically aligned with the at least one bead member.

The communication portion may be disposed in parallel with the at least one bead member to make the bead member be inserted into the communication portion and to make both ends of the communication portion communicate with the spaced gap.

The foregoing and/or other aspects and advantages of the present general inventive concept may also be achieved by providing a nozzle tape used with an inkjet cartridge including a head chip, a cartridge body provided with a head chip-mounting portion spaced apart from edges of the head chip by a predetermined extent, and one or more bead members to protrude along the edges of the head chip, wherein the nozzle tape has a width less than a gap between the bead members or between the bead member and the spaced gap.

This has an effect capable of omitting a process of forming the communication portion by attaching the nozzle tape in a manner of exposing both ends of the spaced gap to the air, without directly forming the communication portion in the nozzle tape.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
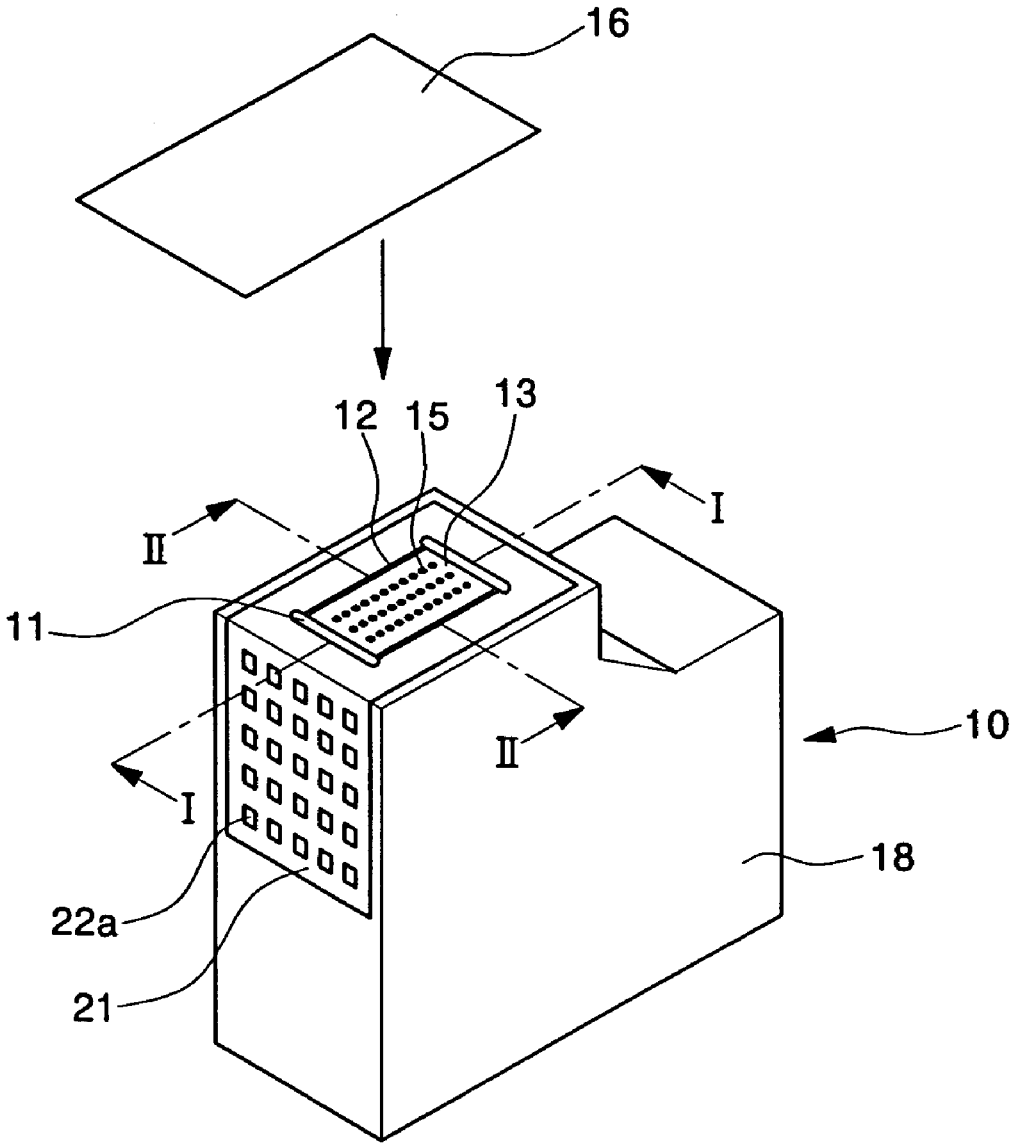
FIG. 1 (PRIOR ART)
FIG. 1 is a perspective view illustrating a state before a nozzle tape is attached to a conventional inkjet cartridge.
Figure 2:
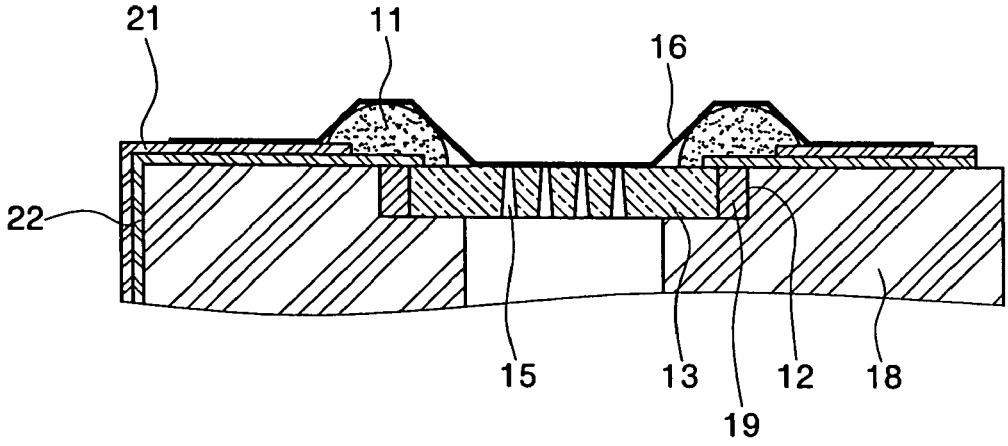
FIG. 2 (PRIOR ART)
FIG. 2 is a cross-sectional view taken along a line I-I of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
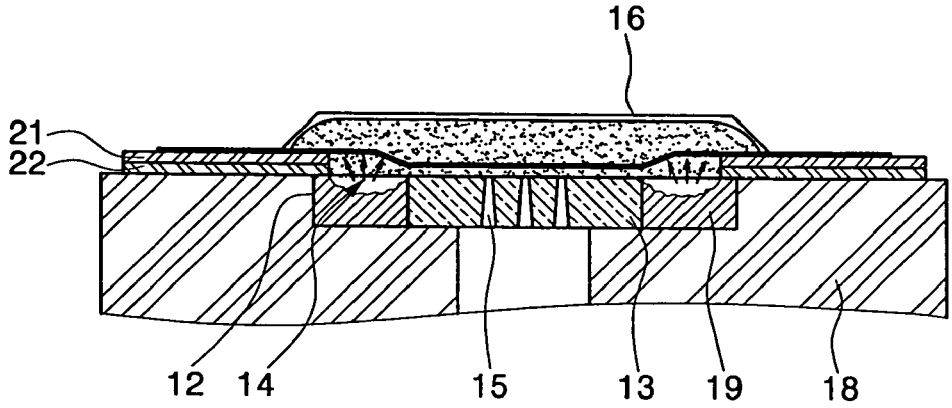
FIG. 3 (PRIOR ART)
FIG. 3 is a cross-sectional view taken along a line II-II of FIG. 1.
Figure 4:
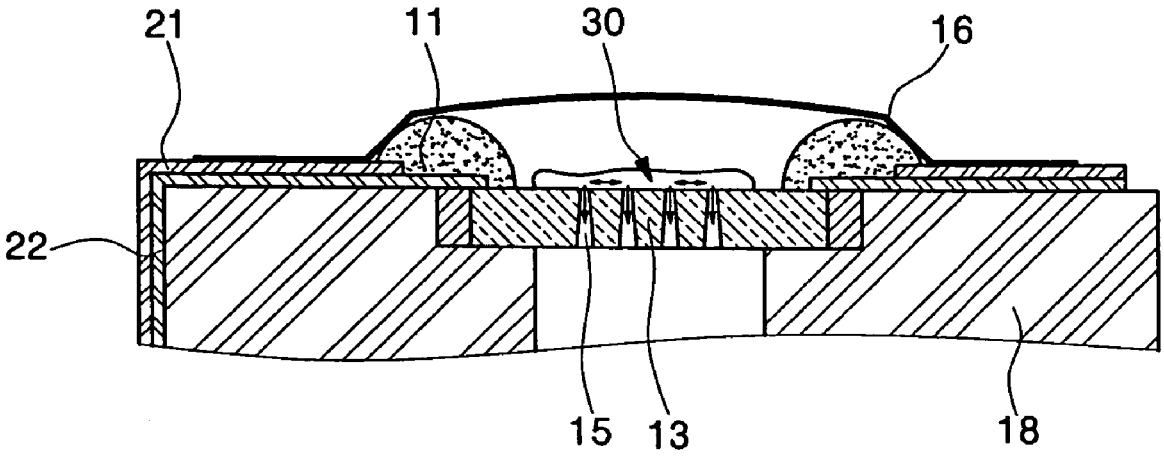
FIG. 4 is a cross-sectional view illustrating a state that a nozzle tape is separated from a surface of a head chip by air expansion.
Figure 5:
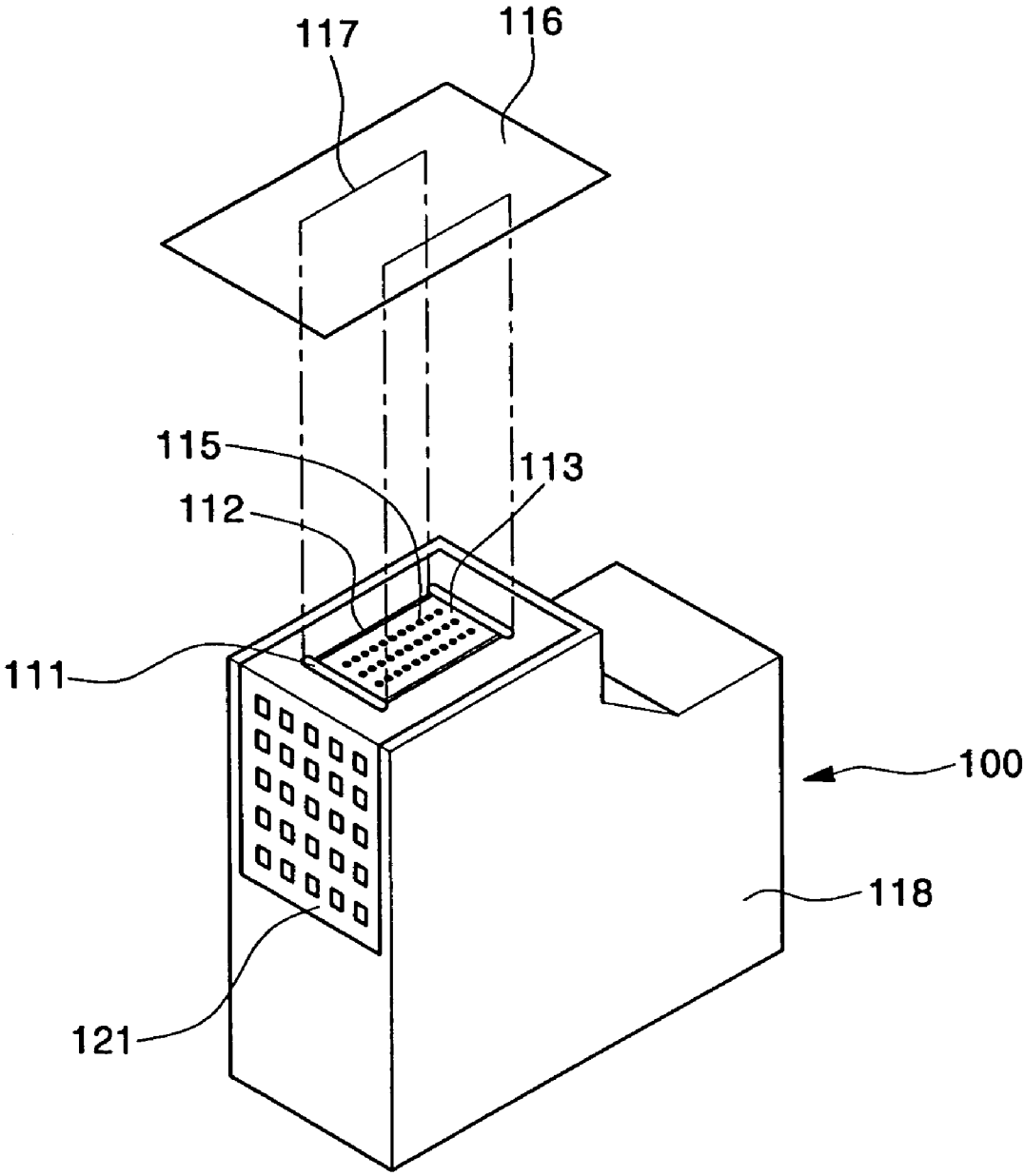
FIG. 5 is a perspective view illustrating a state before a nozzle tape is attached to an inkjet cartridge in accordance with an embodiment of the present general inventive concept.
Figure 6:
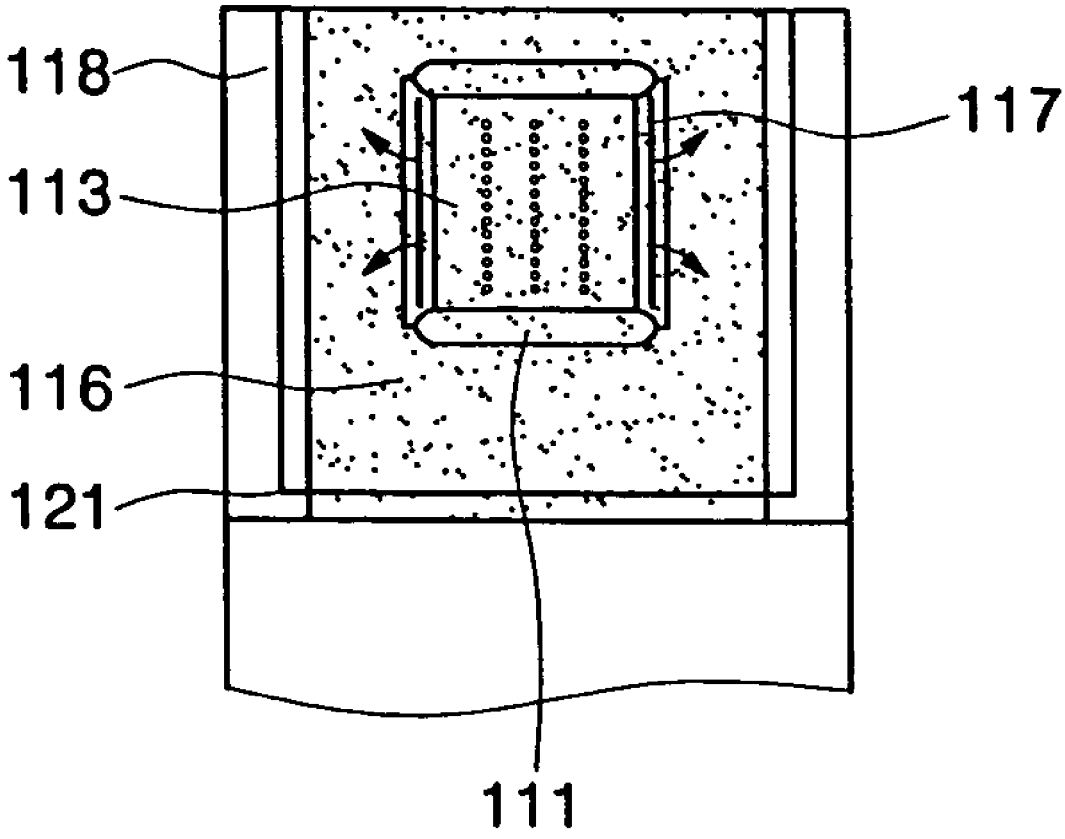
FIG. 6 is a plan view illustrating a state that the nozzle tape is attached to the inkjet cartridge of FIG. 5.

FIG. 5 is a perspective illustrating a state before a nozzle tape 116 is attached to an inkjet cartridge 100 in accordance with an embodiment of the present general inventive concept; and FIG. 6 is a plan view illustrating a state that the nozzle tape 110 is attached to the inkjet cartridge 100 of FIG. 3.

Referring to FIGS. 5 and 6, the inkjet cartridge 100 is provided with a head chip 113, having nozzles 115 for ejecting ink, mounted on a head chip-mounting portion 112 formed at one side of a cartridge body 118. Here, a spaced gap is formed between the head chip 113 and the head chip-mounting portion 112 due to their difference in size. In FIGS. 6 to 11, a nozzle tape (116, 126, 136, 146, 156 or 166) is represented as a dotted portion.

The head chip 113 is connected to a flexible circuit board 121 to receive a control signal, and a bead member 111 is applied to protect a connecting part between the head chip 113 and the flexible circuit board 121.

As shown in FIG. 5, the bead member 111 may be formed of a pair of members opposite to each other with respect to the nozzles 115, a single member or three members. Since the bead member 111 is formed to cover and seal a corresponding spaced gap between the head chip 113 and the head chip-mounting portion 112, in a case of one bead member, the spaced gap is formed at three edges (or sides) where the bead member 111 is not formed, and in a case of two bead members, the spaced gap is formed at two edges (sides) opposite to each other, which are located perpendicular to the bead members.

Meanwhile, the nozzles 115 formed in the head chip 113 have a diameter of about 5~35 μm, and surfaces of the nozzles 115 may be made of nickel, polyimide, epoxy, or SUS (Steel Use Stainless).

The nozzle tape 116 functions to seal the nozzles 115 of the head chip 113, and a slit 117 is formed at a position corresponding to the spaced gap formed between the head chip 113 and the head chip-mounting portion 112 to prevent the nozzle tape 116 from being separated from the head chip 113 due to changes of an environment during transportation and storage of the inkjet cartridge 100. That is, air trapped in the spaced gap under the nozzle tape 116 is expanded due to a temperature increase and a pressure drop in an ambient environment to swell the nozzle tape, at this time, the slit 117 formed at the nozzle tape 116 and in fluid communication with external air discharges the air to the exterior to maintain the nozzle tape 116 and the surfaces of the nozzles 115 to be tightly attached.

Figure 7:
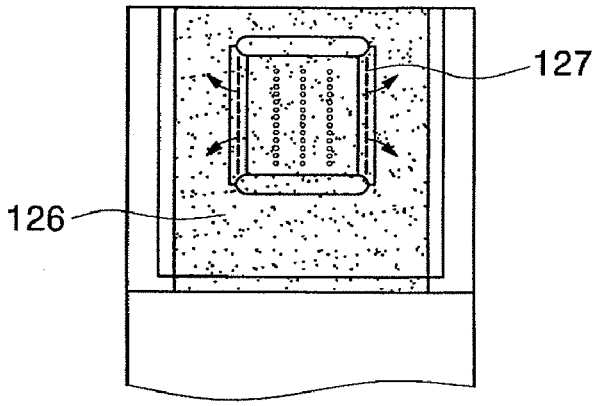
FIG. 7 is a plan view illustrating a nozzle tape attached to an inkjet cartridge in accordance with an embodiment of the present general inventive concept.

The slit 117 shown in FIG. 6 may be manufactured in a simple manner, but it may be readily torn since a stress concentration is generated at its end. Therefore, in order to improve strength of the nozzle tape 116, as shown in FIG. 7, the nozzle tape 126 having a plurality of slits 127 disposed in a row may be attached.

Figure 8:
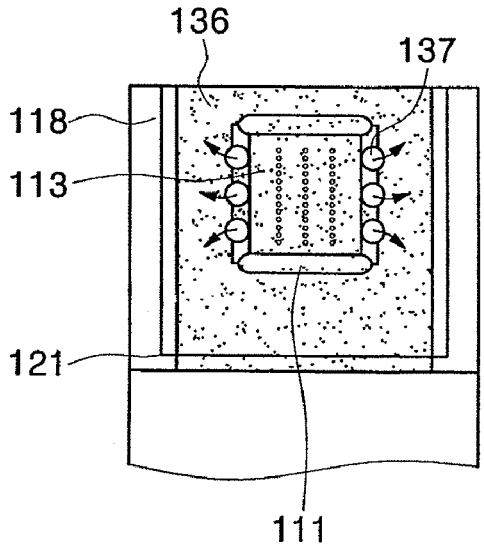
FIG. 8 is a plan view illustrating a nozzle tape attached to an inkjet cartridge in accordance with an embodiment of the present general inventive concept.

In FIG. 8, the nozzle tape 136 has a plurality of circular holes 137 formed in parallel with the spaced gap. In a case of the circular hole, the stress concentration is relieved and the air trapped in the spaced gap is effectively discharged.

Figure 9:
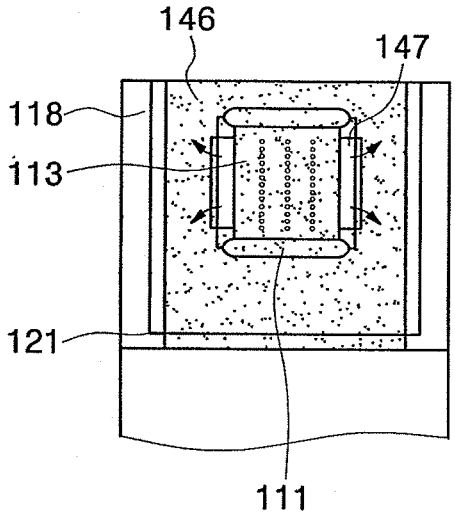
FIG. 9 is a plan view illustrating a nozzle tape attached to an inkjet cartridge in accordance with an embodiment of the present general inventive concept.

In addition, the nozzle tape 146 shown in FIG. 9 has a rectangular hole 147 as a communication portion capable of maximizing an air discharge effect and relieving the stress concentration.

Meanwhile, in FIGS. 6 to 9, the nozzle tape 116, 126, 136 or 146 is not tightly attached around a protruding portion of the bead member 111. That is, the nozzle tape 116 is separated from the head chip 113 at a periphery of the bead member 111 since the nozzle tape 116, 126, 136 or 146 is subjected to tension by the protruding portion of the bead member 111. Since the air is trapped in a separated space, there may exist a separation phenomenon of the nozzle tape 116, 126, 136 or 146 generated by the air trapped in the spaced gap between the head chip 113 and the head chip-mounting portion 112 as described above.

Figure 10:
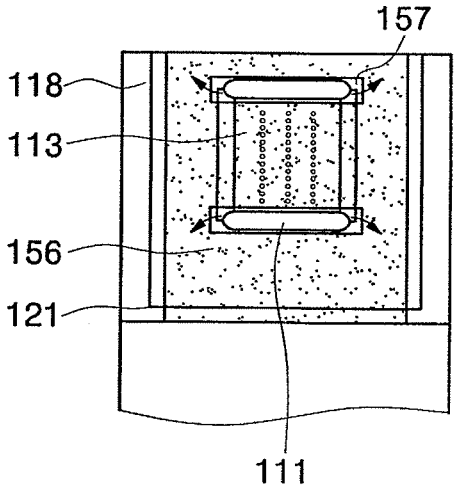
FIG. 10 is a plan view illustrating a nozzle tape is attached to an inkjet cartridge in accordance with an embodiment of the present general inventive concept.

In order to solve the air trap problem around the bead member 111, the nozzle tape 156 of FIG. 10 is provided with a communication portion having a rectangular hole 157 which is disposed in parallel with the bead member 111 to insert the bead member 111 hereinto. The protruding portion of the bead member 111 may be exposed through the rectangular hole 157. Since both ends of the rectangular hole 157 are connected to both ends of the spaced gap between the head chip 113 and the head chip-mounting portion 112, the air trapped in the spaced gap is in fluid communication with an exterior. The separation phenomenon may be prevented effectively since the nozzle tape 156 is tightly attached to a periphery of the protruding portion of the bead member 111.

Figure 11:
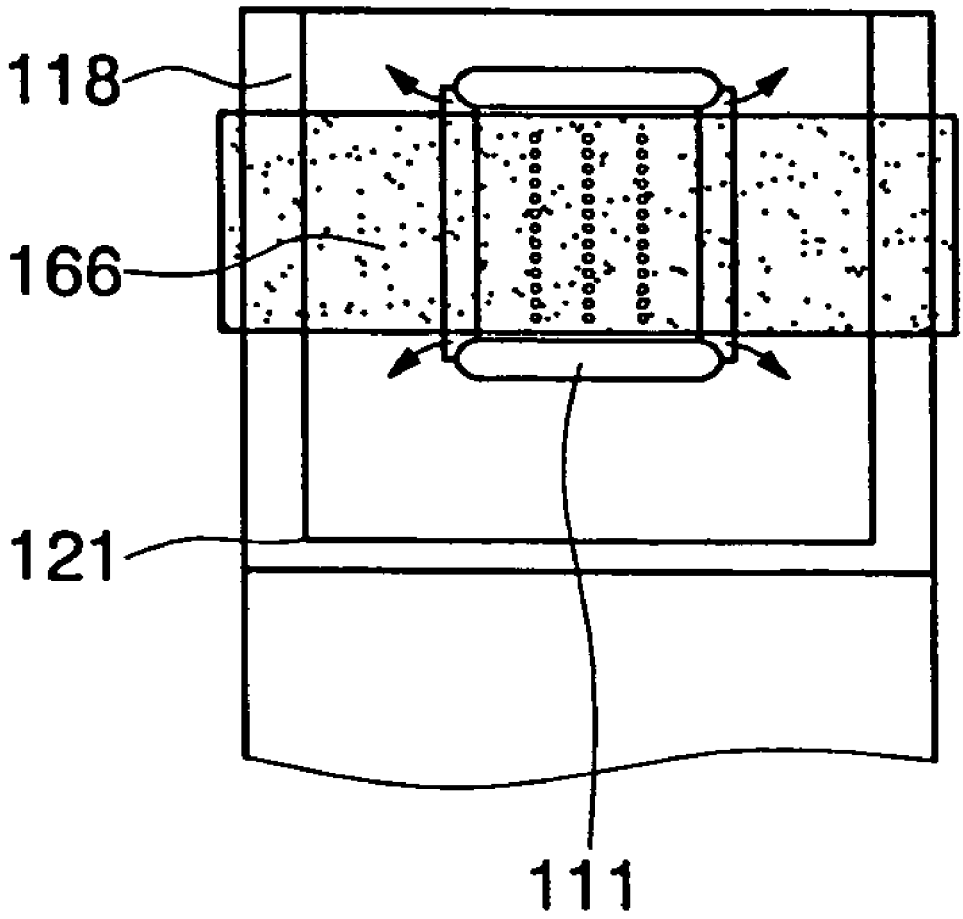
FIG. 11 is a plan view illustrating a nozzle tape attached to an inkjet cartridge in accordance with an embodiment of the present general inventive concept.

FIG. 11 illustrates a nozzle tape 166 according to an embodiment of the present general inventive concept, the nozzle tape 166 having a shape and an attaching method different from the nozzle tape described above. That is, the nozzle tape 166 is not provided with a communication portion, and has a width less than a gap between the bead members 111 to be attached between the bead members 111. When the nozzle tape 166 is laterally attached, the air trapped in the spaced gap is discharged through the both ends of the spaced gap so as to prevent the nozzle tape 166 from being separated from the head chip 113.

Meanwhile, when the bead member 111 is formed along the three edges (sides) out of four edges (sides) of the head chip 113, the spaced gap formed at a remained one edge (side) is disposed opposite to a middle bead member 111, at this time, the nozzle tape is attached to the head chip 113 between the middle bead member 111 and the spaced gap while other bead members are covered by the nozzle tape 166. The nozzle tape 166 may be attached between the other bead members so that both ends of the space gap is not covered by the nozzle tape 166.

An operation of a nozzle tape for an inkjet cartridge in accordance with an embodiment of the present general inventive concept will be described with reference to FIG. 5.

First, an assembly of a head chip 113 and a flexible print circuit 121 is aligned at a reference position to be mounted on a head chip-mounting portion 112 of an inkjet cartridge 100.

A spaced gap is formed between the head chip 113 and the head chip-mounting portion 112, and a side sealant (not shown) is applied to the spaced gap to prevent the ink introduced through the spaced gap under a conductor (not shown) for transmitting control signals to the flexible print circuit 121 and the head chip 113 from generating an electrical short.

Next, a predetermined amount of ink is filled in the inkjet cartridge 100 and an ink meniscus is formed in the nozzles 115 of the head chip 113, and then a nozzle tape 116 is prepared to prevent ink from leaking from the nozzle 115.

The nozzle tape 116 is provided with a communication portion having a slit in fluid communication with the air, and the slit 117 may be disposed in parallel with the spaced gap between the head chip 113 and the head chip-mounting portion 112. The nozzle tape 116 may be attached to cover the head chip 113 including the surfaces of the nozzles 115, the bead member 111, and the spaced gap. At this time, the air may exist in the spaced gap.

The inkjet cartridge 100 at which the nozzle tape 116 is attached is subjected to changes of an external environment during transportation and storage of the inkjet cartridge 100. When the air temperature is increased or pressure is dropped, the air in the spaced gap has swelled volume to generate an expansion pressure. However, the expansion pressure is vanished as the air is discharge through the slit 117 of the nozzle tape 116. As a result, the nozzle tape 116 is capable of maintaining the nozzle 115 in a tight sealing state regardless of changes of the external environment.

As can be seen from the foregoing, the nozzle tape for the inkjet cartridge in accordance with the present general inventive concept has an advantage of maintaining the nozzles in a tight sealing state by providing the communication portion capable of discharging air in a spaced gap between the head chip and the head chip-mounting portion located under the nozzle tape.

In addition, the nozzle tape in accordance with the present general inventive concept has an effect capable of providing a smooth supply of the ink by tightly attaching the nozzle tape to the nozzle surface of the head chip to prevent the ink from mixing due to the ink leakage and to maintain the ink meniscus in the nozzle.

Further, in accordance with the present invention, the nozzle tape can be easily attached to the cartridge as the air in the spaced gap between the head chip and the head chip-mounting portion is discharged through the communication portion.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A nozzle tape used with an inkjet cartridge including a head chip having nozzles, a cartridge body provided with a head chip-mounting portion spaced apart from edges of the head chip by a predetermined extent to define a spaced gap around the head chip, and at least one bead member protruding along the edges of the head chip, wherein the nozzle tape is attached to the head chip of the inkjet cartridge to cover the nozzles and has at least one communication portion in fluid communication with a portion of the spaced gap at a position substantially perpendicular to the at least one bead member.

2. The nozzle tape according to claim 1, wherein the communication portion comprises a slit formed in parallel with the spaced gap.

3. The nozzle tape according to claim 1, wherein the communication portion comprises a plurality of slits disposed in parallel with the spaced gap.

4. The nozzle tape according to claim 1, wherein the communication portion comprises a rectangular hole formed in parallel with the spaced gap.

5. The nozzle tape according to claim 1, wherein the communication portion comprises a hole in fluid communication with the spaced gap disposed over the substantially perpendicular portion of the spaced gap.

6. The nozzle tape according to claim 5, wherein the hole comprises a plurality of sub-holes disposed in parallel with the spaced gap.

7. The nozzle tape according to claim 1, wherein the bead member is formed of two bead members in parallel with two edges of the head chip, and the at least one communication portion comprises two communication portions symmetrically disposed in alignment with the spaced gap between the two parallel bead members.

8. A nozzle tape used with an inkjet cartridge including a head chip having nozzles, a cartridge body provided with a head chip-mounting portion spaced apart from edges of the head chip by a predetermined extent, and at least one bead member protruding along the edges of the head chip, wherein the nozzle tape is attached to the head chip of the inkjet cartridge to cover the nozzles and has at least one communication portion in fluid communication with the spaced gap between the head chip and the head chip-mounting portion, wherein the communication portion is disposed in parallel with the bead member to make the bead member be inserted into the communication portion and to make both ends of the communication portion communicate with the spaced gap.

9. A nozzle tape used with an inkjet cartridge including a head chip, a cartridge body provided with a head chip-mounting portion spaced apart from edges of the head chip by a predetermined extent to form a spaced gap with the head chip, and at least one bead member protruding along the edges of the head chip, wherein the nozzle tape is attached to the head chip of the inkjet cartridge and has a width less than a gap between the spaced gap and at least one of the bead members to cover nozzles of the head chip and expose a portion of the spaced gap substantially perpendicular to the at least one bead member at a position adjacent to the at least one bead member.

10. An inkjet cartridge comprising:

a cartridge body having a head chip-mounting portion formed on a side thereof;

a head chip having a plurality of nozzles, and mounted in the head chip-mounting portion of the cartridge body;

a spaced gap between the head chip and the head chip-mounting portion of the cartridge body;

at least one bead member disposed along at least one side of the head chip to cover a portion of the spaced-gap; and a nozzle tape attached to the head chip to seal the nozzles, and having at least one communication portion to correspond to a portion of the spaced gap substantially perpendicular to the at least one bead member.

11. The inkjet cartridge according to claim 10, wherein the spaced gap communicates with an outside of the nozzle tape through the at least one communication portion.

12. The inkjet cartridge according to claim 10, wherein the cartridge body comprises a flexible circuit board mounted on the cartridge body and having a conductor connected to the head chip to control ejection of ink through the nozzles, and the least one bead member is formed on the flexible circuit board and the head chip to protect a connection portion between the head chip and the conductor of the circuit board.

13. The inkjet cartridge according to claim 12, wherein the at least one bead member is disposed along a first side of the head chip, and the spaced gap and the communication portion are disposed along a second side of the head chip substantially perpendicular to the at least one bead member.

14. The inkjet cartridge according to claim 12, wherein the at least one bead member comprises first and second bead members disposed opposite to each other with respect to the nozzles, and the spaced gap comprises first and second spaced gaps disposed opposite to each other with respect to the nozzles and substantially perpendicular to the first and second bead members.

15. The inkjet cartridge according to claim 14, wherein the at least one communication portion comprises first and second communication portions to correspond to the first and second spaced gaps.

16. The inkjet cartridge according to claim 15, wherein the first and second communication portions are parallel to each other.

17. The inkjet cartridge according to claim 14, wherein the head chip is formed with first and second opposite sides, and the first and second bead members are disposed along the first opposite sides of the head chip while the first and second spaced gaps are disposed along the second opposite sides of the head chip.

18. The inkjet cartridge according to claim 17, wherein the at least one communication portion comprises first and second communication portions to correspond to the first and second spaced gaps.

19. The inkjet cartridge according to claim 14, wherein the nozzle tape has a width less than a distance between the first and second bead members to expose the portion of the spaced gap substantially perpendicular to the at least one bead member adjacent to the at least one bead member.

20. The inkjet cartridge according to claim 19, wherein the nozzle tape is disposed between the first and second bead members.

21. The inkjet cartridge according to claim 19, wherein the nozzle tape comprises a first portion to seal the nozzles and a second portion to cover a portion of the spaced gap so that the second portion does not fully cover the portion of the spaced gap substantially perpendicular to the at least one bead member.

22. The inkjet cartridge according to claim 10, wherein the head chip is formed in a rectangular shape having four sides, and the spaced gap and the communication portion are disposed along at least one of the four sides of the head chip where at least one bead member is not formed.

23. The inkjet cartridge according to claim 10, wherein the communication portion is disposed along the spaced gap and a side of the head chip facing the head chip-mounting portion.

24. The inkjet cartridge according to claim 10, wherein the communication portion comprises a plurality of holes spaced apart at an interval along a line parallel to the spaced gap.

25. The inkjet cartridge according to claim 24, wherein the holes are formed in one of a circular shape and a rectangular shape.

26. The inkjet cartridge according to claim 10, wherein the communication portion comprises two longitudinal slits formed opposite to each other with respect to the nozzles.

27. The inkjet cartridge according to claim 10, wherein the communication portion comprises a plurality of slits disposed parallel to a line passing through the nozzles.

28. The inkjet cartridge according to claim 10, wherein the portion of the spaced gap substantially perpendicular to the at least one bead member comprises end portions and a middle portion disposed between the end portions, and the nozzle tape does not cover the end portions of the spaced gap.

29. The inkjet cartridge according to claim 10, wherein the nozzle tape covers the middle portion of the portion of the spaced gap substantially perpendicular to the at least one bead member.

30. The inkjet cartridge according to claim 10, wherein the communication portion has the same length as the portion of the spaced gap substantially perpendicular to the at least one bead member.

31. The inkjet cartridge according to claim 10, wherein the communication portion has an area to allow air trapped in the spaced gap to be discharged through the communication portion.

32. The inkjet cartridge according to claim 10, wherein the communication portion has an area to allow air expanded from the spaced gap to be discharged through the communication portion without detaching the nozzle tape from the head chip.

33. The inkjet cartridge according to claim 10, wherein the cartridge body comprises a flexible circuit board mounted on the cartridge body and having a conductor connected to the head chip to control ejection of ink through the nozzles, and at least one bead member formed on the flexible circuit board and the head chip to protect a connection portion between the head chip and the conductor of the circuit board, and the nozzle tape comprises a first portion to seal the nozzles, a second portion having the communication portion, and a third portion to expose a portion of the at least one bead member.

34. The inkjet cartridge according to claim 33, wherein the portion of the at least one bead member protrudes from a major surface of the head chip.

35. The inkjet cartridge according to claim 33, wherein the at least one bead member comprises two bead members spaced-apart from each other, and the third portion of the nozzle tape comprises two holes to exposed the respective bead members.

36. The inkjet cartridge according to claim 33, wherein the first portion is disposed between the second portion and the third portion.

37. The inkjet cartridge according to claim 33, wherein the third portion of the nozzle tape is attached to a periphery of the at least one bead member.

38. The inkjet cartridge according to claim 33, wherein the at least one bead member comprises a protruding portion and a periphery around the protruding portion, and the periphery of the at least one bead member is disposed between the third portion of the nozzle tape and an area containing the nozzles.

39. The inkjet cartridge according to claim 33, wherein the nozzle tape comprises a fourth portion attached to the area of the nozzles.

40. A nozzle tape used on an inkjet cartridge, the inkjet cartridge comprising:

a head-chip having a plurality of nozzles;

a head-chip mounting portion to mount the head-chip, defining a plurality of spaced gaps between an edge of the head-chip mounting portion and an edge of the head-chip mounted therein; and at least one encapsulating bead to cover and seal at least one of the plurality of spaced gaps, wherein the nozzle tape is attached to the inkjet cartridge to cover the plurality of nozzles and the nozzle tape comprises:

at least one communication port in fluid communication with at least one spaced gap not covered by the at least one bead member and substantially perpendicular to the at least one bead member.

* * * * *